US010197034B2

(12) United States Patent
Saliu et al.

(10) Patent No.: US 10,197,034 B2
(45) Date of Patent: Feb. 5, 2019

(54) NOZZLE ASSEMBLY AND FUEL INJECTION VALVE FOR A COMBUSTION ENGINE

(71) Applicant: Continental Automotive GmbH, Hannover (DE)

(72) Inventors: Marco Saliu, Sassari (IT); Nicola Canesi, Regensburg (DE); Luca Matteucci, Pisa (IT); Marco Mechi, Vada (IT)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 0 days.

(21) Appl. No.: 15/111,551

(22) PCT Filed: Jan. 13, 2015

(86) PCT No.: PCT/EP2015/050483
§ 371 (c)(1),
(2) Date: Jul. 14, 2016

(87) PCT Pub. No.: WO2015/107039
PCT Pub. Date: Jul. 23, 2015

(65) Prior Publication Data

US 2016/0333839 A1 Nov. 17, 2016

(30) Foreign Application Priority Data

Jan. 15, 2014 (EP) ..... 14151231

(51) Int. Cl.
*F02M 61/18* (2006.01)
*F02M 51/06* (2006.01)

(52) U.S. Cl.
CPC ..... *F02M 61/188* (2013.01); *F02M 51/0664* (2013.01); *F02M 61/1886* (2013.01);
(Continued)

(58) Field of Classification Search
CPC ..... F02M 61/188; F02M 61/1886; F02M 51/0664; F02M 2200/06; F02M 61/1806; F02M 61/18
(Continued)

(56) References Cited

U.S. PATENT DOCUMENTS 3,442,451 A * 5/1969 Nagel ..... F02M 45/083 239/453
4,168,804 A * 9/1979 Hofmann ..... F02M 61/182 239/533.11
(Continued)

FOREIGN PATENT DOCUMENTS

DE 2711902 A1 9/1978 ..... F02M 61/06
DE 102004030445 A1 1/2006 ..... F02M 45/00
(Continued)

OTHER PUBLICATIONS

Megahed, von Mustafa et al., "Einfluß der Düsengeometrie auf die Dieselstrahlausbreitung," MTZ Motortechnische Zeitschrift, vol. 54, No. 12, pp. 656-659 (German w/ English statement of relevance), Dec. 1, 1993.
(Continued)

*Primary Examiner* — Chee-Chong Lee
*Assistant Examiner* — Joseph A Greenlund
(74) *Attorney, Agent, or Firm* — Slayden Grubert Beard PLLC

(57) ABSTRACT

The present disclosure generally relates to nozzles for a valve and, more specifically, to a fuel injection valve for a combustion engine. In some embodiments, a nozzle assembly for a fuel injection valve for a combustion engine may include: a valve body with a central longitudinal axis; a valve cavity within the valve body; a nozzle tip body comprising a protrusion limiting a free volume of the valve cavity; and at least one nozzle aperture out from the valve
(Continued)

cavity through the protrusion. The protrusion may extend from an end surface of the nozzle tip body in an extending direction parallel to a longitudinal axis of the nozzle tip body away from the valve cavity and comprise a first section adjacent to the end surface, the first section having a cylindrical outer surface, and a second section adjacent to the first section, the second section having an outer surface of decreasing diameter in the course away from the end surface along the extending direction.

10 Claims, 2 Drawing Sheets

(52) U.S. Cl.
CPC ..... *F02M 61/18* (2013.01); *F02M 61/1806* (2013.01); *F02M 2200/06* (2013.01)

(58) Field of Classification Search
USPC ..... 239/584, 533.2, 96
See application file for complete search history.

(56) References Cited

U.S. PATENT DOCUMENTS 4,269,360 A * 5/1981 Kopse ..... F02M 61/06 239/533.8
4,758,169 A * 7/1988 Steiger ..... F02M 45/08 239/446
5,487,508 A * 1/1996 Zuo ..... F02B 75/22 239/533.5
5,732,889 A * 3/1998 Sasao ..... F02M 51/005 239/585.1
5,899,389 A * 5/1999 Pataki ..... F02M 45/086 239/533.2
6,338,445 B1 * 1/2002 Lambert ..... F02M 45/086 137/630.22
6,439,483 B2 * 8/2002 Meyer ..... F02M 45/00 239/533.11
6,557,776 B2 * 5/2003 Carroll, III ..... F02M 45/086 239/124
6,637,675 B2 * 10/2003 Carroll, III ..... F02M 45/086 239/124
6,705,543 B2 * 3/2004 Carroll, III ..... F02M 45/04 239/124
6,789,752 B2 * 9/2004 Dantes ..... F02M 51/0671 239/491
7,082,921 B2 * 8/2006 Shimizu ..... F02B 23/104 123/298
7,415,969 B2 * 8/2008 Sun ..... F02M 63/0045 123/467
8,083,160 B2 * 12/2011 Kato ..... F02M 51/0671 239/533.12
2002/0060256 A1 * 5/2002 Kishi ..... F02M 53/04 239/533.2
2004/0172823 A1 * 9/2004 Yoda ..... F02M 47/027 29/888.01
2007/0200011 A1 * 8/2007 Ibrahim ..... F02M 47/027 239/533.2
2008/0251607 A1 * 10/2008 Krayer ..... B05B 7/0081 239/290
2011/0042491 A1 * 2/2011 Abe ..... F02M 61/188 239/584
2012/0072035 A1 * 3/2012 Nielsen ..... B05B 12/004 700/283
2016/0333839 A1 * 11/2016 Saliu ..... F02M 51/0664

FOREIGN PATENT DOCUMENTS

DE 102005019328 A1 11/2006 ..... F02M 51/06
DE 102008001083 A1 11/2008 ..... F02M 61/18
DE 102007000670 B4 6/2010 ..... F02M 61/18
EP 1201915 A2 5/2002 ..... F02M 53/04
WO 02/35082 A1 5/2002 ..... F02M 51/06
WO 2015/107039 A1 7/2015 ..... F02M 51/06

OTHER PUBLICATIONS

"Düsen und Düsenhalter," Bosche Technische Unterrichtung, vol. 97/98, No. 1, pp. 44-49 (German w/ English statement of relevance), Aug. 1, 1997.
European Search Report, Application No. 14151231.9, 10 pages, dated May 2, 2014.
International Search Report and Written Opinion, Application No. PCT/EP2015/050483, 15 pages, dated Mar. 13, 2015.
Chinese Office Action, Application No. 201580004779.7, 14 pages, dated Dec. 1, 2017.
Korean Notice of Allowance, Application No. 2018046689503, 3 pages, dated Jul. 10, 2018.

* cited by examiner

NOZZLE ASSEMBLY AND FUEL INJECTION VALVE FOR A COMBUSTION ENGINE

CROSS-REFERENCE TO RELATED APPLICATIONS

This application is a U.S. National Stage Application of International Application No. PCT/EP2015/050483 filed Jan. 13, 2015, which designates the United States of America, and claims priority to EP Application No. 14151231.9 filed Jan. 15, 2014, the contents of which are hereby incorporated by reference in their entirety.

TECHNICAL FIELD

The present disclosure generally relates to nozzles for a valve and, more specifically, to a fuel injection valve for a combustion engine.

BACKGROUND

Fuel injection valves are in widespread use, in particular for internal combustion engines, where they may be arranged in order to dose a fluid into an intake manifold of the internal combustion engine or directly into a combustion chamber of a cylinder of the internal combustion engine. Due to increasingly strict legal regulations concerning the admissibility of pollutant emissions by internal combustion engines, which are arranged in motor vehicles for example, it is necessary to take action in various ways in order to reduce these pollutant emissions.

One possible starting point is to reduce the pollutant emissions, which are directly produced by the combustion engine. For example, the generation of soot is highly dependent on the fuel-mixture preparation in a respective cylinder of the combustion engine. An improved fuel mixture preparation can be achieved by dosing the fuel under high pressure. With respect to gasoline fuel combustion engines, such high pressure can be 200 bar or even larger. Such high pressures require high demands on the material of a fuel injection valve and its construction. Additionally, the fuel injection valve needs to absorb high forces.

SUMMARY

One object of the present disclosure is to describe a nozzle assembly for a fuel injection valve for a combustion engine, which facilitates a reliable and precise function and/or which has a particularly low risk for sooting at the injection valve tip.

In some embodiments, a nozzle assembly (3) for a fuel injection valve (1) for a combustion engine, may comprise a valve body (7) with a central longitudinal axis (15), the valve body comprising a valve cavity (13) and a nozzle tip body (23). The nozzle tip body (23) limits a free volume of the valve cavity (13) and comprises a protrusion (31). The protrusion (31) extends from an end surface (33) of the nozzle tip body (23) in an extending direction parallel to a longitudinal axis (16) of the nozzle tip body (23) away from the valve cavity (13). The protrusion (31) comprises a first section (35) adjacent to the end surface (33), which has a cylindrical outer surface, and a second section (37) adjacent to the first section (35), which has an outer surface of decreasing diameter in the course away from the end surface (33) along the extending direction and which comprises at least one nozzle aperture (25).

In some embodiments, the second section (37) comprises a conical outer surface (38).

In some embodiments, a cone angle ($\alpha$) of the conical outer surface (38) is in between 130° to 150°.

In some embodiments, the second section (37) comprises a round end (39).

In some embodiments, the second section (37) comprises a round end (39) which is arranged subsequent to the conical outer surface (38) in the course away from the end surface (33) along the extending direction.

In some embodiments, the round end (39) comprises a radius in between 3.0 mm to 5.0 mm.

In some embodiments, the protrusion (31) has a length (41), starting from the end surface (33) and parallel to the extending direction, between 0.7 mm to 1.5 mm, the limits being included.

In some embodiments, the first section (35) has a length (43), starting from the end surface (33) and parallel to the extending direction, between 0.3 mm to 0.8 mm, the limits being included.

In some embodiments, an outside-diameter (45) of the first section (35) perpendicular to the extending direction has a value between 4.0 mm to 4.5 mm, the limits being included.

In some embodiments, a wall thickness (47) of the protrusion (31) is between 0.3 mm to 0.4 mm.

In some embodiments, an interface of the first section (35) to the second section (37) is rounded.

In some embodiments, an interface of the end surface (33) to the first section (35) is rounded.

BRIEF DESCRIPTION OF THE DRAWINGS

An exemplary embodiment of the invention is explained in the following with the aid of schematic drawings and reference numbers. Identical reference numbers designate elements or components with the same functions. Insofar as elements or components correspond to one another in function, the description of them will not be repeated in each of the following figures.

In the figures.

DETAILED DESCRIPTION

Figure 1:
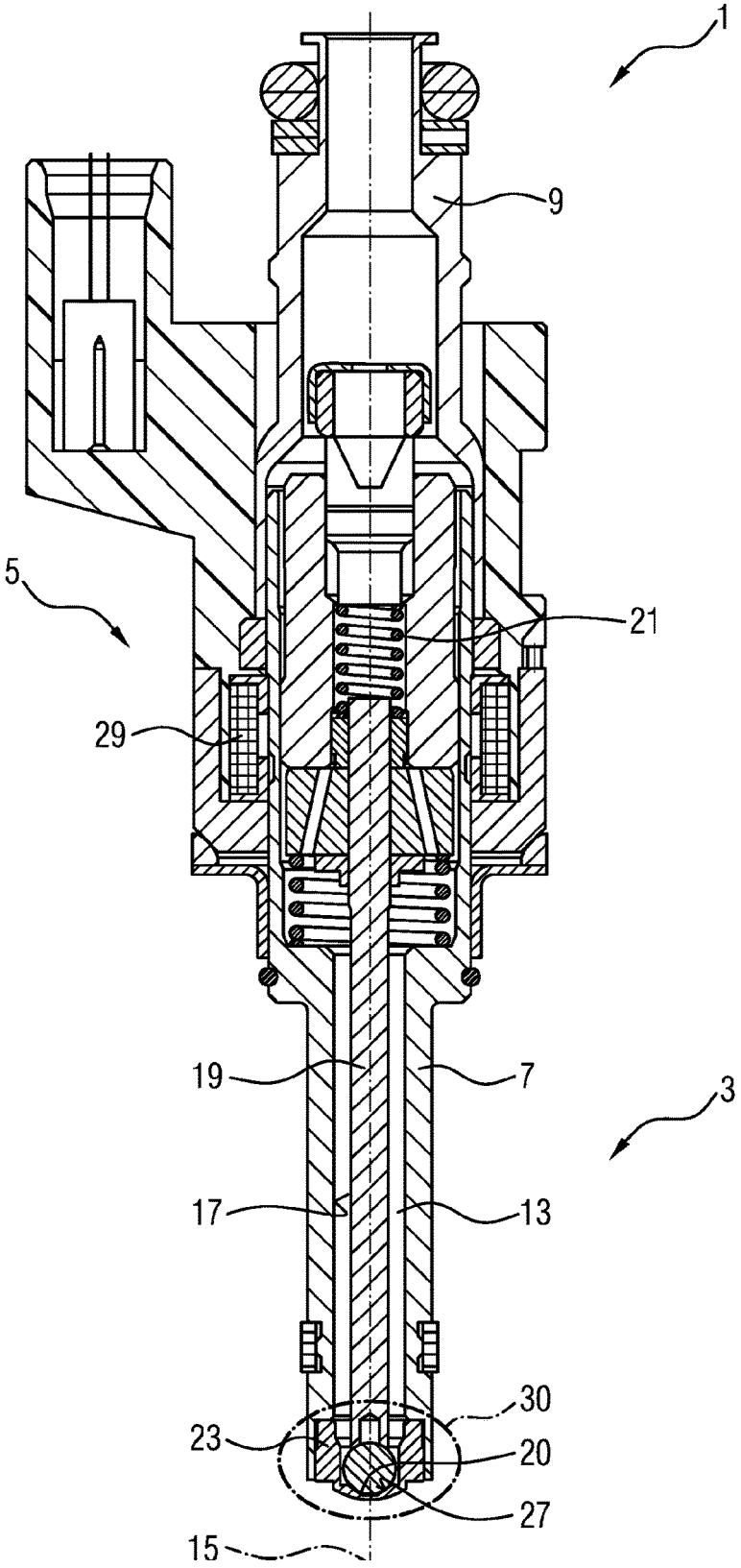
FIG. 1 shows an injection valve according to the exemplary embodiment in a longitudinal section view.

According to one aspect of the present disclosure, a nozzle assembly for a fluid injection valve is disclosed. According to a further aspect, a fluid injection valve for a combustion engine is disclosed. The fluid injection valve is in particular a fuel injection valve. The fluid injection valve may comprise the nozzle assembly. The combustion engine is in particular an internal combustion engine of a motor vehicle. The fuel injection valve may be configured for injecting fuel directly into a combustion chamber of the combustion engine.

In some embodiments, the nozzle assembly comprises a valve body with a central longitudinal axis. The valve body comprises a valve cavity and a nozzle tip body. The nozzle tip body can also be called injector tip. The nozzle tip body limits a free volume of the valve cavity and comprises a protrusion. The protrusion extends from an end surface of the nozzle tip body in an extending direction parallel to a longitudinal axis of the nozzle tip body away from the valve cavity. The extending direction is in particular directed towards the combustion chamber of the internal combustion engine. The longitudinal axis of the nozzle tip body may be parallel or coaxial to the central longitudinal axis.

The end surface may face away from the valve cavity. It may be an outer surface of the nozzle assembly and of the fuel injection valve and preferably faces a combustion chamber of the combustion engine. In some embodiments, the end surface extends perpendicularly to the longitudinal axis of the nozzle tip body.

In some embodiments, the protrusion comprises a first section adjacent to the surface, which comprises a cylindrical outer surface, and a second section adjacent to the first section, which comprises an outer surface of decreasing diameter in the course away from the end surface in the extending direction. In particular, the diameter of the second section is decreasing gradually so that the second section has a smooth outer surface without kinks or steps. The second section additionally comprises at least one nozzle aperture.

In some embodiments, a base body of the valve body and the nozzle tip body may be two separate components. For example, the base body extends along the longitudinal axis of the valve body from a fuel inlet end to a fuel outlet end and the nozzle tip body is fixed to the base body at the fuel outlet end. In this case, a side wall of the base body may extend circumferentially around the nozzle tip body. Alternatively, the valve body may be a one piece element. In this case, the nozzle tip body is represented by a fuel outlet section of the valve body.

The nozzle assemblies described herein may have a particularly small risk for the formation of deposits on the outer surface of the nozzle tip body when the nozzle tip body is arranged in a combustion chamber of the combustion engine. Such deposits on the injector tip deteriorate the injection valve functions during engine application. In addition, a particularly small risk of wetting surfaces of combustion chamber elements like walls, spark plugs and charge-cycle valves is achievable due to the advantageous geometry of the injector tip. In this way, particularly small pollutant emissions of the combustion engine are achievable.

Injector tip deposits are mainly generated by the so-called "tip-wetting" behavior, wherein fuel droplets remain on the injector tip after an injection process. Fuel droplets on the injector tip are responsible for the degradation of emission performances. During the injection process, the fluid, for example fuel like gasoline or diesel, wets the surface of the injector tip. This leads to deposits like the formation of soot and non-combusted particles, which essentially consist of carbon and result from coking of the wet residues on the injector tip. This leads to a high carbon- (also HC-) and particle emissions, which are a key parameter of, for example, the European Emission Normative EU6C.

By means of the shape of the injector tip of the nozzle assembly according to the teachings of the present disclosure, the risk for an aggregation or adhesion of droplets on the nozzle tip body and its surfaces facing the combustion chamber is particularly small. Thus, coking of fluid, respectively fluid droplets, and formation of deposits during injection and combustion processes can be largely avoided and a particularly low pollutant emission or particle emission is achievable.

By providing the first section of the protrusion with a cylindrical outer surface, an extension of the second section of the nozzle tip body into the combustion chamber is increased such that an opening of the at least one nozzle aperture can be exposed to high temperatures, for example between 250° and 300° C. This favors the evaporation of fuel liquids that can be present on the nozzle tip body during injection, thereby reducing the pollutant emissions.

At the same time, pushing the whole injector deep into the combustion chamber for achieving high temperatures at the injector tip can be avoided. In this way, for example, exposure of sensitive parts of the injector, like seals, the valve needle or the valve body, to the high temperatures can be avoided or reduced. Exposure of these sensitive parts to the high temperatures would increase the risk for losing their functionality. Additionally, no modifications of combustion chamber seals and any modifications to the whole injector body architecture need to be done for positioning the injector tip deeper inside the combustion chamber as compared to injectors with conventional tips.

The cylindrical outer surface has a function to offer a particularly high mechanical resistance at a joint between the protrusion and the end surface, without reducing a space on the end surface. In some embodiments, the end surface is perpendicular to the longitudinal axis of the nozzle tip body. The end surface is usable for assembly operations, like press fitting, sealing, welding, and marking. By means of the cylindrical outer surface, a large area can be provided on the end surface around the protrusion for such assembly functions.

Additionally, wetting of the surface of the nozzle tip body may be avoided or reduced, since the first section establishes a sufficient distance relative to the longitudinal axis between a spray jet dispensed from the at least one nozzle aperture and the end surface.

In some embodiments, the second section comprises a conical outer surface. The cone angle of the conical outer surface may be in between 130° to 150°. The conical outer surface smoothes the transition from the cylindrical outer surface to the outmost axial endpoint of the protrusion at its axial end remote from the end surface. The conical outer surface may also permit to maximize the material distribution of the protrusion in order to guarantee a mechanical resistance of the nozzle.

In some embodiments, the second section comprises a round end. The round end is in particular arranged subsequent to the conical outer surface in the course away from the end surface along the extending direction. The round end has in particular an outer surface which is in the shape of a spherical cap. Preferably, the round end—in particular the spherical cap—has a radius in between 3.0 mm to 5.0 mm. The round end, which in other words is a spherical end or a spherical tip, permits to have a particularly high mechanical resistance of the nozzle tip body in combination with a particularly low wall thickness. Thereby, a length of a hole of the at least one nozzle aperture can be reduced, which favors spray performances like a lower penetration of a fluid spray through the at least one nozzle aperture. Additionally, overall costs of the injector or the nozzle tip body can be achieved due to lower material use.

In some embodiments, the protrusion has a length, starting from the end surface and parallel to the extending direction, having a value in a range from 0.7 mm to 1.5 mm, the limits being included. Such an overall length of the protrusion may position the second section of the nozzle tip body with the at least one nozzle aperture extends in an area of the combustion chamber where the temperatures during injection and combustion are very high, as explained above. Thereby, a high mechanical resistance of the nozzle tip body is maintained.

In some embodiments, the first section has a length, starting from the end surface and parallel to the extending direction, having a value in a range from 0.3 mm to 0.8 mm, the limits being included. This guarantees a maximum mechanical resistance of the nozzle tip body.

In some embodiments, an outside-diameter of the first section perpendicular to the extending direction has a value in the range from 4.0 mm to 4.5 mm, the limits being included. In other words, the lateral dimension of the first section is between 4.0 mm and 4.5 mm. Such an outside diameter, in particular in combination with the length of the first section between 0.3 mm and 0.8 mm—enables a high material distribution for mechanical resistance, in particular at the joint between the protrusion and the end surface.

In some embodiments, a wall thickness of the protrusion is in the range from 0.3 mm to 0.5 mm, the limits being included. Such a thickness allows to have a reduced penetration of a fluid jet, in particular due to a large divergence which is achievable for the fluid jets being dispensed from the nozzle apertures in walls of such dimensions. Additionally, no complicated nozzle aperture shapes—such as step holes—need to be provided, which saves manufacturing costs. In particular, with injectors having a plurality of nozzle apertures, such a wall thickness in combination with a radius of the round end of the second section has the advantageous effect that hole lengths of the nozzle apertures only vary slightly, even when the nozzle assembly in one embodiment comprises nozzle apertures the hole axes of which have different angles to the longitudinal axis of the nozzle tip body.

In some embodiments, an interface of the first section with the second section is rounded. In another embodiment, alternatively or additionally, an interface of the end surface with the first section is rounded. Such interfaces guarantee high mechanical resistances of the protrusion, since the distribution of forces is improved and a notch effect is avoided.

FIG. 1 shows an injection valve 1 with a nozzle assembly 3 and an actuator 5. The actuator 5 functionally interacts with the nozzle assembly group 3.

The injection valve 1 may inject a fluid directly into the combustion chamber of an internal combustion engine. In this case, the fluid is in particular a fuel, for example, gasoline or diesel. It is also conceivable that the fluid injection valve 1 is provided for dispensing other substances, for example organic compounds like carbonide.

The nozzle assembly 3 comprises a valve body with a base body 7 and a nozzle tip body 23. In the shown embodiment, the base body 7 and the nozzle tip body 23 are separate elements of the valve body, wherein the nozzle tip body 23 is fixedly coupled to the base body 7. Alternatively, the base body 7 and the nozzle tip body 23 can be in one piece and form the valve body. The actuator 5 comprises a fluid inlet tube 9. The valve body is fixedly coupled to the fluid inlet tube 9, for example by a nozzle clamping nut. The valve body and the fluid inlet tube 9 form a common housing of the injection valve 1.

The valve body has a valve cavity 13 which extends along a central longitudinal axis 15 of the valve body from a fluid inlet end of the valve body to a fluid outlet end of the valve body. The cavity 13 is laterally delimited by a circumferential wall 17 of the base body 7. Within the valve cavity 13, a needle 19 is arranged, which constitutes the nozzle assembly 3 together with the valve body. The needle 19 has a round end 20 at one end, the round end being comprised by a sealing element of the needle 19. The sealing element is fixed to a shaft of the needle 19 at an axial end facing towards the fluid outlet end of the valve body. The needle 19 is axially guided in the valve cavity 13 and is biased by a spring element 21.

The nozzle tip body 23 limits a free volume of the valve cavity 13. In other words, the cavity 13 is delimited at the fluid outlet end of the valve body by means of the nozzle tip body 23. The nozzle tip body 23 comprises several nozzle apertures 25. The nozzle tip body 23 further comprises a valve seat 27, in which the needle 19 sealingly rests with its round end 20 in a closed position. The needle 19 is biased towards the closed position by the spring element 21. Details of the nozzle tip body 23 will be explained below with reference to FIGS. 2 and 3.

The actuator 4 has a coil 29 for generating a magnetic field. The actuator 4 actuates the needle 19 by means of the magnetic field such that the needle 19 can perform a movement along a direction of the central longitudinal axis 15 against the bias of the spring element 21.

The spring element 21 exerts a force on the needle 19 in order to prevent an unintended flow of the fluid through one or several nozzle apertures of the needle tip body 23. The exerted force acts in a direction of closing, i.e. in axial direction towards the closed position. By actuating the coil 29, the needle 19 is moved in axial direction towards the fluid inlet end along the central longitudinal axis 15, in order to move the needle 19 away from its closed position to an open position. Thus, the flow of the fluid out of the injection valve through the several nozzle apertures is enabled.

Figure 2:
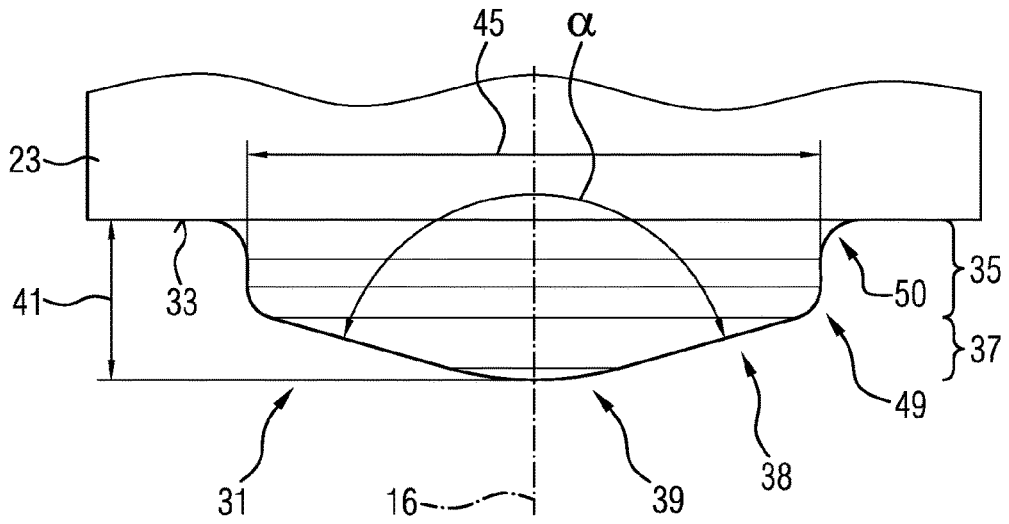
FIG. 2 shows an enlarged side view of a nozzle tip body of the injection valve.
Figure 3:
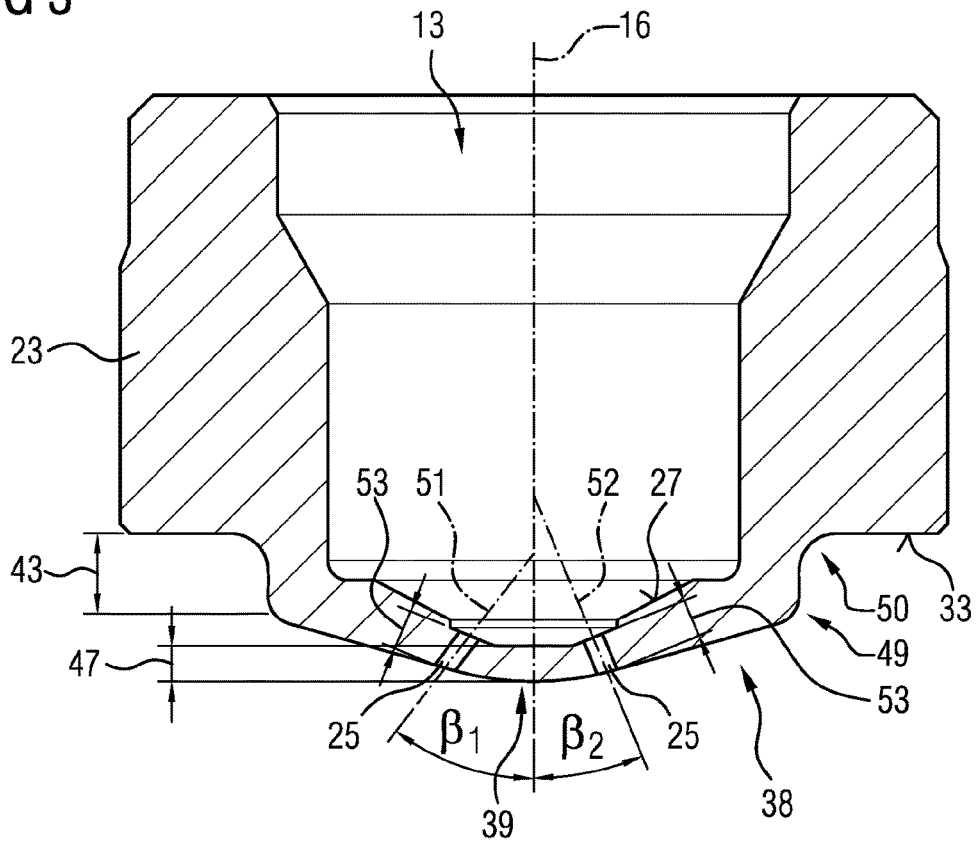
FIG. 3 shows a schematic sectional view of the nozzle tip body.

In FIGS. 2 and 3 described below, enlarged views of the injection valve 1 corresponding to a region 30 of FIG. 1 are shown, which show an exemplary constructional design of the nozzle tip body 23. The nozzle tip body 23 can also be called injector tip of the injection valve 1. FIG. 2 shows an enlarged side view of the nozzle tip body 23. FIG. 3 shows a schematic longitudinal section view through the nozzle tip body 23.

In case that the needle 19 enables a flow of fluid, fluid can pass through the nozzle apertures 25 into the combustion chamber of the combustion engine. In conventional injection valves, there is a risk that such an injection process may cause the fluid to wet the injector tip, for example at surfaces like an end surface 33 of the nozzle tip body 23. The end surface 33 can also be called base area of the nozzle tip body 23. As described above, due to the high temperatures during a combustion process, the droplets or accumulated droplets can coke and thus coking deposits are generated and may be attached to the end surface 33. Such coking deposits are responsible for the generation of soot and for emission performance degradation, as stated above.

In order to reduce the risk for such tip wetting phenomenon, the nozzle tip body 23 of the injection valve 1 according the present embodiment has a protrusion 31 with a first section 35 adjacent to the end surface 33 and a second section 37 adjacent to the first section 35 on a side of the first section 35 remote from the end surface 33. The protrusion 31 extends in an extending direction along a longitudinal axis 16 of the nozzle tip body 23. The first section 35 comprises a cylindrical outer surface and may be called the cylindrical protrusion base. The second section 37 comprises an outer surface of decreasing diameter in the course away from the end surface 33 and along the extending direction. The second section 37 additionally comprises the nozzle apertures 25 (see FIG. 3).

The diameter decreases relative to the longitudinal axis 16 of the nozzle tip body 23 in the extending direction of the protrusion. The second section 37 comprises a conical outer surface 38, which preferably has a conical angle $\alpha$ in between 130° to 150°. Adjacent to the conical outer surface 38, the second section 37 comprises a round end 39, which preferably has an outer surface in the shape of a spherical cap with a radius in between 3.0 mm to 5.0 mm. According to the shown embodiment, the longitudinal axis 16 of the nozzle tip body 23 is co-axial to the longitudinal axis 15 of the valve cavity 13. Alternatively, both longitudinal axes may extend inclined with respect to one another.

In some embodiments, the second section 37 of the protrusion 31 may only comprise a round end or only a conical outer surface.

The protrusion 31 comprises has a length 41, starting from the end surface 33 and parallel to the extending direction of the protrusion 31, wherein the length 41 of the protrusion 31 is in between 0.7 mm to 1.5 mm. The first section 35 has a length 43, starting from the end surface 33 and parallel to the extending direction, wherein the length 43 of the first portion 35 is in between 0.3 mm to 0.8 mm. Furthermore, the first section 35 has an outside diameter 45 perpendicular to the extending direction of between 4.0 mm to 4.5 mm. The protrusion 31 further has a wall thickness 47, which is in between 0.3 mm to 0.5 mm. Furthermore, an interface 49 of the first section 35 with the second section 37 is rounded. A transition 50 of the end surface 33 to the first section 35 is rounded, too.

As explained above, the shown design of the nozzle tip body 23 permits that the second section 37 is extended more deeply into a combustion chamber at a predetermined position of the end surface 33 with respect to the combustion chamber. This has the effect that the second section 37 is exposed to very high temperatures during the combustion process, for example between 250° C. and 300° C. This favors the evaporation of fluid stuck to the second section 37 in an area around the nozzle apertures 25 and reduces a particle emission and a formation of soot. Additionally, wetting of the surface of the nozzle tip body is avoided or reduced, since openings of the nozzle apertures 25 are at distance to end surface which distance is large enough for reducing or completely avoiding a contact of spray jets of fluid through the nozzle aperture 25 with the end surface 33.

The tip radius permits to have a low wall thickness in between 0.3 mm and 0.4 mm, wherein a mechanical resistance of the nozzle tip body 23 is maintained sufficiently high to resist forces which are caused due to high pressures during the injection processes. By the combination of the diameter 45 of the first section and the length 41 of the protrusion 31, a very high mechanical resistance is achieved at the joint between the first section 35 and the end surface 33. This mechanical resistance is further increased by the rounded transition 50. Further, by means of the low wall thickness, fluid jets of high divergence and, thus, in some embodiments, there is a short jet penetration length for every nozzle aperture 25.

Due to the low wall thickness 47 hole lengths 53 of the nozzle apertures 25 may vary only little, even when angles of hole axes of the nozzle apertures are different, as exemplary shown in FIG. 3. In FIG. 3 two nozzle apertures 25 are shown, wherein one nozzle aperture 25 has a first hole axis 51 and the other nozzle aperture 25 has a second hole axis 52. The first hole axis 51 forms a first angle $\beta_1$ with the longitudinal axis 16 of the nozzle tip body 23 and the second hole axis 52 forms a second angle $\beta_2$ with the longitudinal axis 16 of the nozzle tip body 23. Even though $\beta_1$ is different from $\beta_2$, the hole lengths 53 of the two nozzle aperture 25 vary only little. In other words, hole lengths 53 of the nozzle apertures 25 are within a small range. This has the effect that a reduced jet penetration can be achieved for every nozzle aperture 25, even when the hole axes of the nozzle apertures 25 extend at shallow angles with respect to the end surface 33. At the same time, due to the cylindrical base shaped by the first section 35, the risk of wetting the end surface 33 by these fluid jets is low.

What is claimed is:

1. A nozzle assembly for a fuel injection valve for a combustion engine, the nozzle assembly comprising:

a valve body with a central longitudinal axis;

a valve cavity within the valve body; and a nozzle tip body comprising a protrusion limiting a free volume of the valve cavity;

wherein the protrusion extends from an end surface of the nozzle tip body in an extending direction parallel to a longitudinal axis of the nozzle tip body away from the valve cavity; and the protrusion comprises a first section adjacent to the end surface, the first section having a cylindrical outer surface, and a second section adjacent to the first section, the second section having an outer surface of decreasing diameter in the course away from the end surface along the extending direction and terminating in a round end opposite the first section;

the protrusion defines a valve seat for receiving a nozzle needle;

a plurality of nozzle apertures extending out from the valve cavity through the protrusion at a location downstream from the valve seat, wherein a wall thickness of the protrusion in a location of each nozzle aperture is between 0.3 mm to 0.5 mm, inclusive, and wherein the round end of the second section of the protrusion comprises a radius in between 3.0 mm and 5.0 mm, inclusive, such that the radius of the round end of the second section of the protrusion is at least 6 times as large as the wall thickness of the protrusion in the locations of the nozzle apertures, to thereby define similar longitudinal aperture lengths for the plurality of nozzle apertures.

2. A nozzle assembly according to claim 1, wherein the second section comprises a conical outer surface.

3. A nozzle assembly according to claim 2, wherein a cone angle of the conical outer surface is in between 130° and 150°, inclusive.

4. A nozzle assembly according to claim 2, wherein the round end of the second section is located subsequent to the conical outer surface in the course away from the end surface along the extending direction.

5. A nozzle assembly according to claim 1, wherein the protrusion has a length, starting from the end surface and parallel to the extending direction, between 0.7 mm and 1.5 mm, inclusive.

6. A nozzle assembly according to claim 1, wherein the first section has a length, starting from the end surface and parallel to the extending direction, between 0.3 mm and 0.8 mm, inclusive.

7. A nozzle assembly according to claim 1, wherein an outside-diameter of the first section perpendicular to the extending direction has a value between 4.0 mm and 4.5 mm, inclusive.

8. A nozzle assembly according to claim 1, further comprising a rounded interface between the first section and the second section.

9. A nozzle assembly according to claim 1, further comprising a rounded interface between the end surface and the first section.

10. A nozzle assembly for a fuel injection valve, the assembly comprising:

a valve body with a central longitudinal axis;

a valve cavity defined within the valve body;

a nozzle tip body including a protrusion extending from an end surface of the nozzle tip body parallel to a longitudinal axis of the nozzle tip body and away from the valve cavity;

a first section of the protrusion adjacent to the end surface, the first section comprising a cylindrical outer surface;

a second section of the protrusion adjacent the first section and further away from the end surface, the second section comprising a conical outer surface with an outer diameter decreasing in a direction along the longitudinal axis away from the first section terminating in a round end opposite the first section; and wherein the protrusion defines a valve seat for receiving a nozzle needle;

a plurality of nozzle apertures, each extending from the valve cavity through the protrusion at a location downstream from the valve seat;

wherein a length of the first section measured from the end surface parallel to the longitudinal axis is between 0.3 mm and 0.8 mm, inclusive;

a outside diameter of the first section measured perpendicular to the longitudinal axis is between 4.0 mm and 4.5 mm, inclusive;

a cone angle of the second section is between 130 and 150 degrees, inclusive; and a radius of the round end of the second section of the protrusion is between 3.0 mm and 5.0 mm, inclusive;

wherein the radius of the round end of the second section of the protrusion is at least 6 times as large as a wall thickness of the protrusion in a location of each of the plurality of nozzle apertures, to thereby define similar longitudinal aperture lengths for the plurality of nozzle apertures.

* * * * *